United States Patent [19]

Okada

[11] Patent Number: 4,887,370

[45] Date of Patent: Dec. 19, 1989

[54] SKI BOOT MADE OF HARD SYNTHETIC RESIN

[75] Inventor: Takashi Okada, Shizuoka, Japan

[73] Assignee: Yamaha Corp., Japan

[21] Appl. No.: 212,949

[22] Filed: Jun. 29, 1988

[30] Foreign Application Priority Data

Jun. 29, 1987 [JP] Japan ..... 62-162172

[51] Int. Cl.[4] ..... A43B 5/04

[52] U.S. Cl. ..... 36/120; 36/121

[58] Field of Search ..... 36/117–121, 36/105

[56] References Cited

U.S. PATENT DOCUMENTS

| | | | |
|---|---|---|---|
| 3,849,914 | 11/1974 | Bertele | 36/119 |
| 4,083,129 | 4/1978 | Collombin et al. | 36/117 |
| 4,265,034 | 5/1981 | Salomon | 36/121 |
| 4,575,957 | 3/1986 | Petrini | 36/121 |
| 4,587,747 | 5/1986 | Courvoisier et al. | 36/117 |
| 4,724,626 | 2/1988 | Baggio . | |
| 4,747,221 | 5/1988 | Hayes | 36/119 |

FOREIGN PATENT DOCUMENTS

| | | | |
|---|---|---|---|
| 0015862 | 9/1980 | European Pat. Off. | 36/117 |
| 0253306 | 1/1988 | European Pat. Off. | 36/117 |
| 3044052 | 6/1982 | Fed. Rep. of Germany | 36/120 |

*Primary Examiner*—James Kee Chi

*Attorney, Agent, or Firm*—Ostrolenk, Faber, Gerb & Soffen

[57] ABSTRACT

A ski boot includes a rear shell at least partly formed in one body with its sole, and a front shell pivoted to the sole in an arrangement turnable forwards for entry of a wearer's foot into the ski boot. Forwardly turnable construction of the front shell allows smooth entry of the wearer's foot without enlarging the construction which cannot afford good fit to and sufficient hold on the wearer's foot and one body construction of the rear shell with the sole well withstand rearward tilting of the wearer's leg during skiing.

9 Claims, 9 Drawing Sheets

SKI BOOT MADE OF HARD SYNTHETIC RESIN

BACKGROUND OF THE INVENTION

The present invention relates to a ski boot made of hard synthetic resin and having improved fit to a wearer's foot.

Conventional ski boots made of hard synthetic resin are roughly classified into two major types, i.e. a rear-entry type and a front-entry type. One example of the rear-entry type ski boot is disclosed in Japanese Patent Opening Sho. 62-112503. The ski boot of this earlier application is made up of a sole, a front shell formed in one body with the sole and a rear shell pivoted to the front shell and tiltable rearwards for entry of a wearer's foot. In one example of the front-entry type, the ski boot is made up of a sole, a rear shell formed in one body with the sole and a front shell made up of left and right pieces which are respectively turnable sideways for entry of a wearer's foot. In another example of this type, a tongue is arranged between left and right pieces and turnable forwards for entry of wearer's foot.

The conventional ski boot of the rear-entry type, the boot cannot sufficiently hold the wearer's foot when the wearer tilts his leg rearwardly.

The human foot is generally largest just in front of the shank and the size of the opening formed by turning of the corresponding shell should be large enough to allow free passage of the portion of the foot at the entry of the wearer's foot. This naturally requires a large construction of the boot. In addition, foot sizes vary greatly from wearer to wearer and a ski boot must be large in construction so that one boot size can span as many foot sizes as possible. These factors concur to make the size of a ski boot unduly larger than necessary for accommoding wearer' feet. Because of such an unduly large construction, a ski boot generally does not fit a wearer's foot well and, as a consequence, cannot provide reasonable hold on the foot in particular when the wearer's leg is moved significantly.

In order to improve the fit to a wearer's foot, it has been proposed to use an inner boot made of soft material such as sponge. More specifically, such an inner boot is inserted into a ski boot in order to fill a space between the shells and a wearer's foot. A pad is often additionally provided within the ski boot in contact with the instep of the wearer's foot. Such a pad can be pressed against the instep by means of a cable or a screw which is operable from outside the ski boot. The Achilles' tendon may be fastened by a proper tensioner arranged on the rear face of the ski boot.

However, these expedients provide local fastening of the wearer's foot only, admittedly somewhat better than no expedients. The problems of poor fit and insufficient hold on the wearer's foot remains due to the absence of overall fastening. In addition, conventional tensioners used for this purpose are generally complicated in construction.

SUMMARY OF THE INVENTION

It is the object of the present invention to provide a ski boot made of hard synthetic resin which can afford good fit to and sufficient hold on a wearer's foot even when the wearer's leg is moved greatly and violently.

In accordance with the basic aspect of the present invention, a rear shell is formed at least partly in one body with a sole of a ski boot and a front shell, which is separate from the rear shell, is pivoted to the front end of the sole in an arrangement rotatable in the longitudinal direction of the ski boot.

DESCRIPTION OF THE PREFERRED EMBODIMENTS

Figure 1:
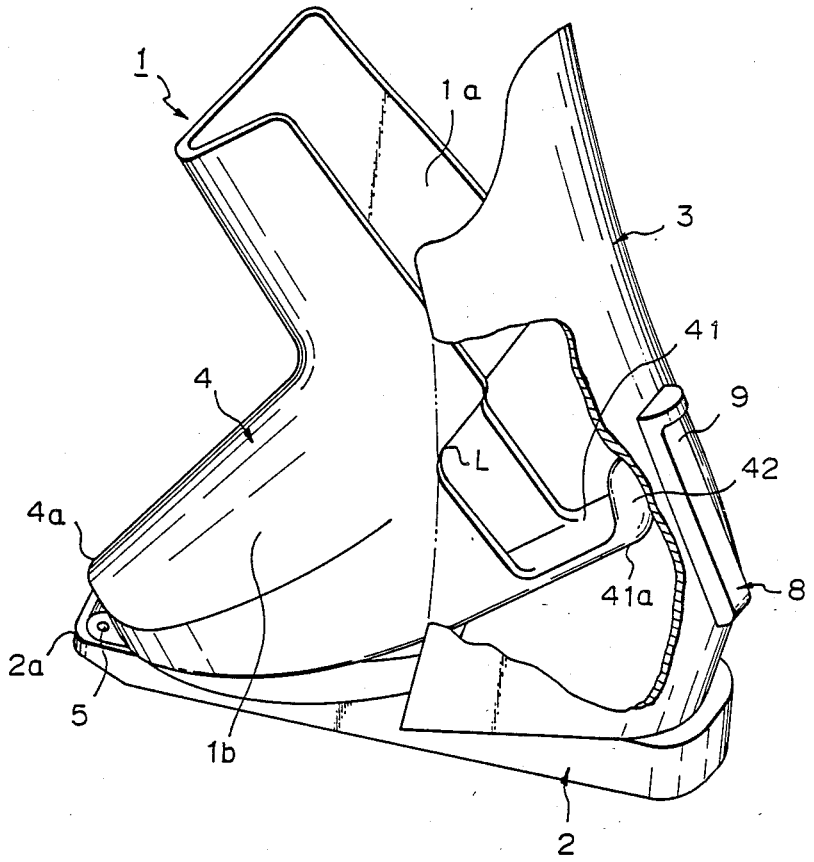
FIG. 1 is a perspective view of the first embodiment of the ski boot in accordance with the present invention in which its front shell is rotated forwards.

The first embodiment of the ski boot in accordance with the present invention is shown in FIG. 1, in which the ski boot 1 is made of hard synthetic resin. The ski boot 1 is made up of a sole 2, a rear shell 3 forming the rear half of the Achilles' tendon covering section 1*a* and heel section of the ski boot and a front shell 4 forming the front half of the Achilles' tendon section 1*a* and the instep covering section 1*b* of the ski boot 1. At the bottom end, the rear shell 3 is formed in one body with the sole 2. Whereas the front shell 4 is pivoted at its front end 4*a* to the front end 2*a* of the sole 2 via a transverse horizontal pin 2*b* in an arrangement turnable in the longitudinal direction of the ski boot 1. More specifically, the front shell 4 is rotatable forwards to form an opening for entry of a wearer's foot.

Figure 2A:
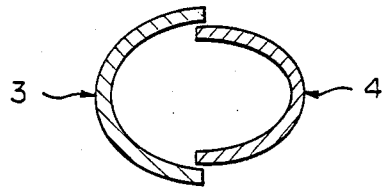
FIGS. 2A to 2C are transverse cross-sectional views of various modes of combination of the front and rear shells of the boot of FIG. 1.
Figure 2B:
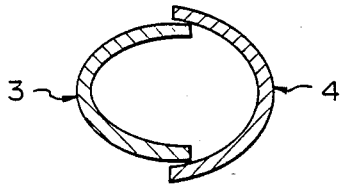
Figure 2C:
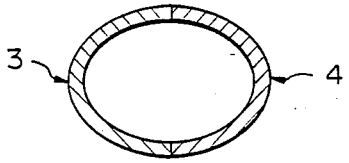

Near the bottom end of the boot 1, rear edges 4*b* of the front shell 4 are configurated so that they should evade the medial mallelus of the wearer's foot entering the ski boot 1. More specifically, the line of separation L between the rear and front shells 3, 4 can take various fashions as shown in FIGS. 2A to 2C. In the case of the example shown in FIG. 2A, the rear edges 4*b* of the front shell 4 are covered by the rear shell 3 whereas the rear edges 4*b* of the front shell 4 cover the rear shell 3 in the case of the example shown in FIG. 2B. In the case of the example shown in FIG. 2C, the rear edges 4*b* of the front shell 4 meet the front edges of the rear shell 3.

Figure 3:
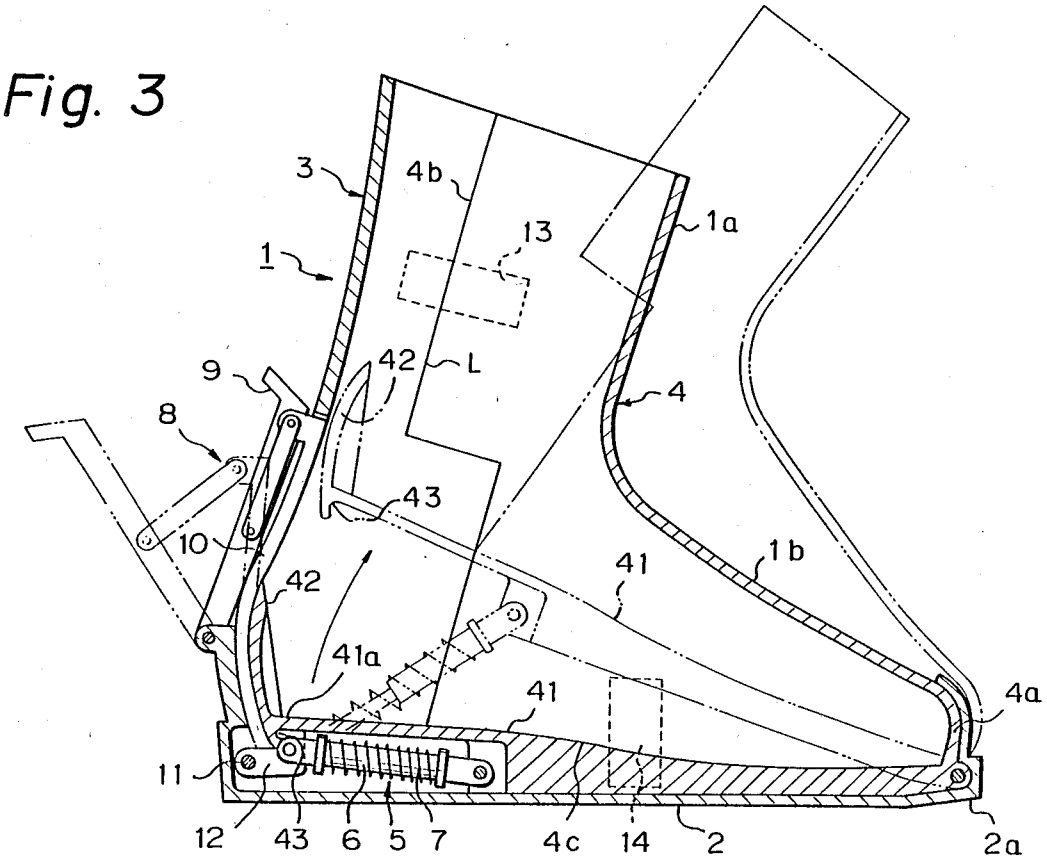
FIG. 3 is a side sectional view of the ski boot of FIG. 1.

Further, as shown integrally FIG. 3, an inner sole 41 is formed in with the front shell 4 while extending towards the rear shell 3 to provide the front shell 4 with a slipper-like configuration. Further, the rear end 41*a* of the inner sole 41 is provided with a curved tongue 42 which projects upwards to embrace the heel of the wearer's foot entering the ski boot 1. Preferably, the tongue 42 is configured like a shoehorn. When the front shell 4 is turned forwards as shown with two-dot chain lines in FIG. 3 for entry of the wearer's foot, the tongue 42 with this special configuration prevents the foot from interfering with the inner face of the rear shell 3 to enable smooth entry into the ski boot 1. When the front shell 4 is rotated forwards, this open position is maintained by a retainer unit 5.

In FIG. 3, the retainer unit 5 includes a cylinder rod 6 which is pivoted to the sole 2 at its front end and to the rear shell 3 at its rear end. A compression spring 7 is attached to the cylinder rod 6 so as to elastically urge the front shell 4 to rotate upwards and forwards.

A locking unit 8 is attached to the rear face of the rear shell 3. The locking unit 8 includes a release lever 9 pivoted to the bottom end to the sole 2, a locking piece 12 pivoted to a transverse horizontal pin 11 fixed in the rear end of the sole 2, and a link 10 connecting the release lever 9 to the locking piece 12. The spring 7 is compressed by the pressure of the wearer's foot entering the ski boot 1 on the inner sole 41 and the front shell 4 is rotated rearwards towards the closed position. By manual operation on the release lever 9 at this moment, the locking piece 12 connected to the release lever 9 via the link 10 is brought into engagement with a hook 43 formed below the rear end 41*a* of the inner sole 41 and the front shell 4 is maintained firm in the closed position.

The ski boot 1 is further provided with closure units 13 and 14. The first closure unit 13 extends between the rear and front shells 3, 4 in order to fasten them together when the front shell 4 is in the closed position. The second closure unit 14 extends between the front shell 4 and the sole 2 in order to fasten them together when the front shell 4 is in the closed position.

Figure 4:
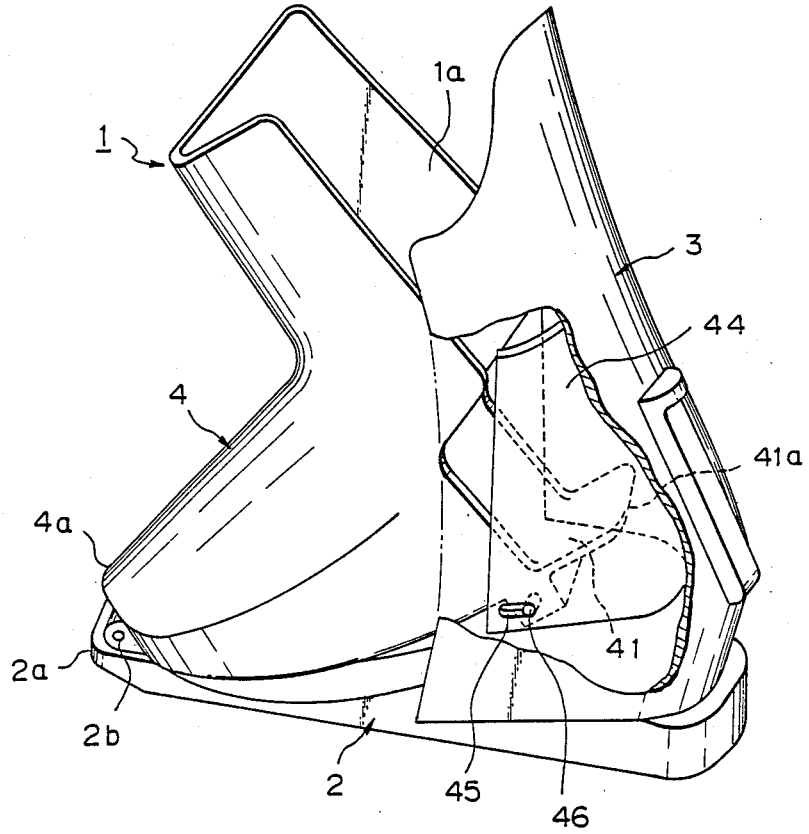
FIG. 4 is a perspective view of the second embodiment of the ski boot in accordance with the present invention in which the front shell is rotated fowards.
Figure 5:
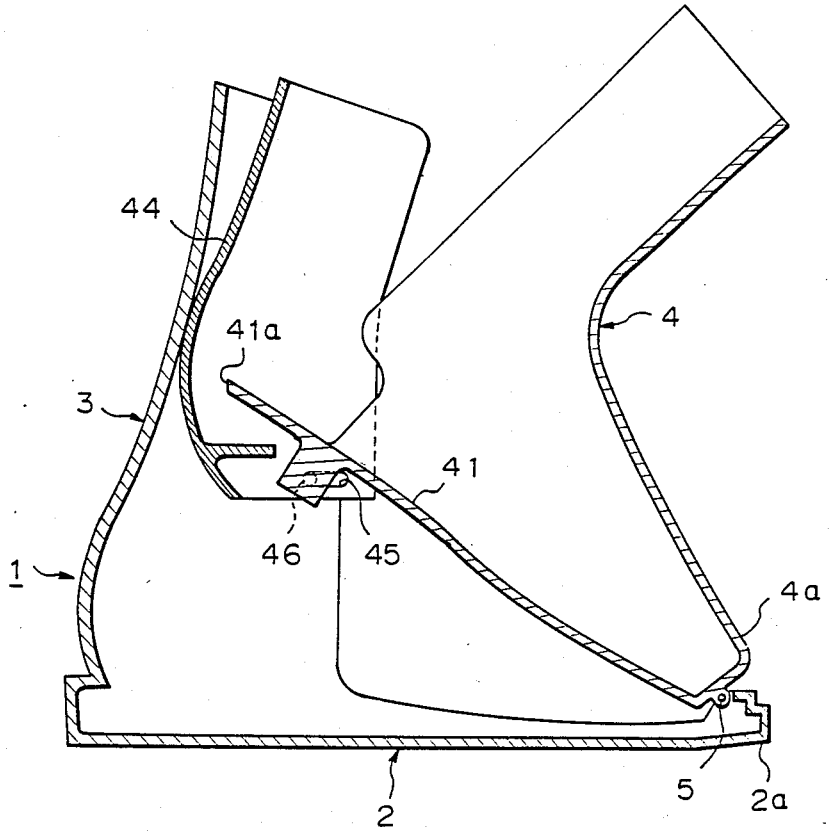
FIG. 5 is a side sectional view of the ski of FIG. 4 with its front shell fully rotated forwards.
Figure 6:
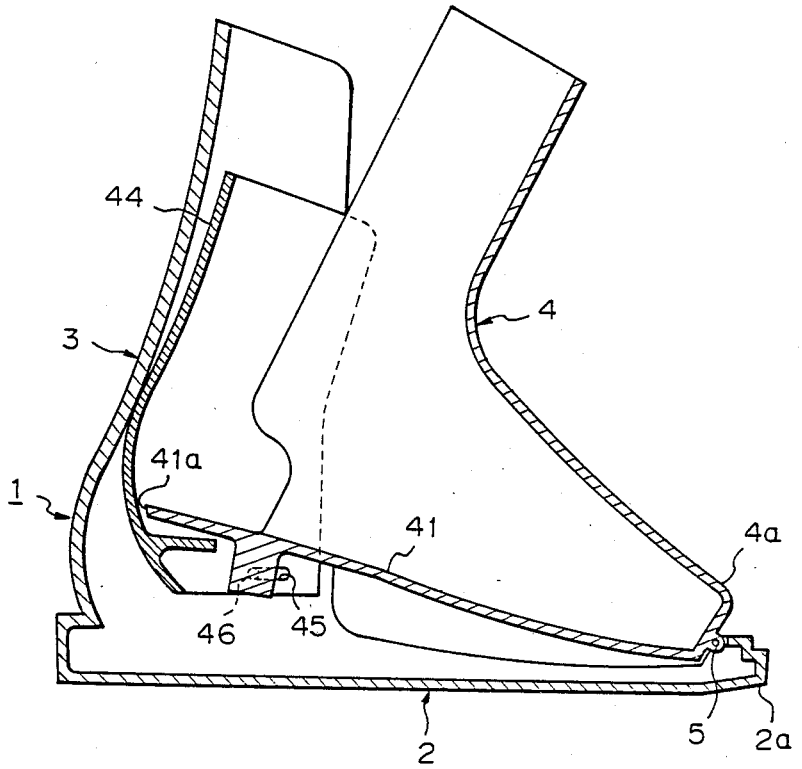
FIG. 6 is a side sectional view of the ski boot of FIG. 4 with its front shell partly rotated forwards.
Figure 7:
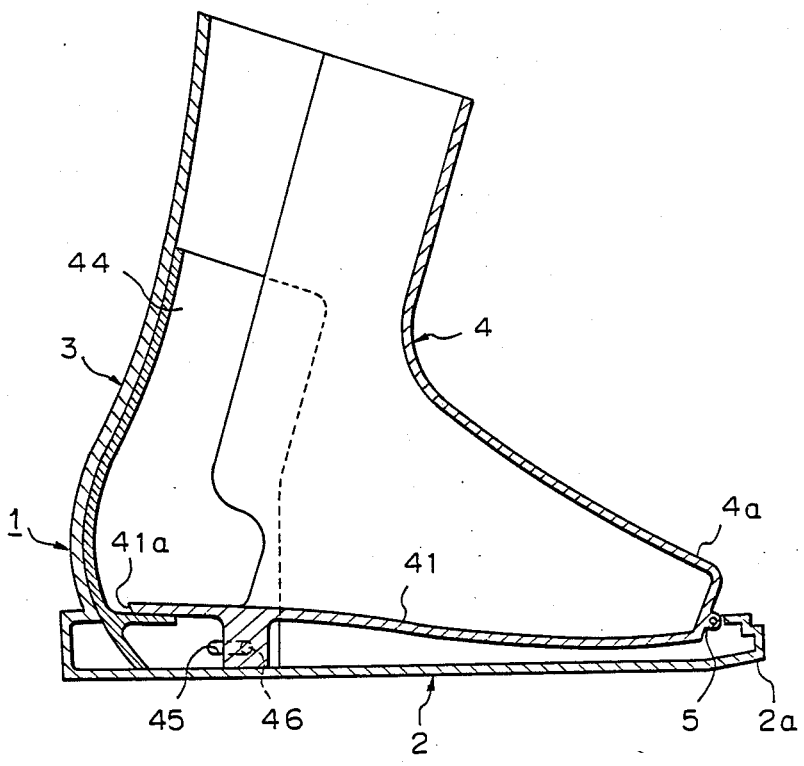
FIG. 7 is a side sectional view of the ski boot of FIG. 4 with its front shell fully rotated forwards.

The second embodiment of the ski boot in accordance with the present invention is shown in FIGS. 4 to 7. As shown in FIG. 4, an inner rearcuff 44 is used as a substitute for the shoehorn like tongue 42 used in the first embodiment shown in FIG. 1. More particularly, the inner rearcuff 44 is formed separately from the inner sole 41 and is provided, at its front bottom corners, with slots 45 in engagement with lateral horizontal pins 46 formed on the rear end of the inner sole 41. Thanks to this slot-pin engagement, the inner rearcuff 44 does not follow the movement of the inner sole 41 even when the latter is rotated forwards with the front shell 4. This construction allows easier entry of the wearer's foot than the ski boot 1 shown in FIG. 1, as best seen in FIG. 5.

Figure 8:
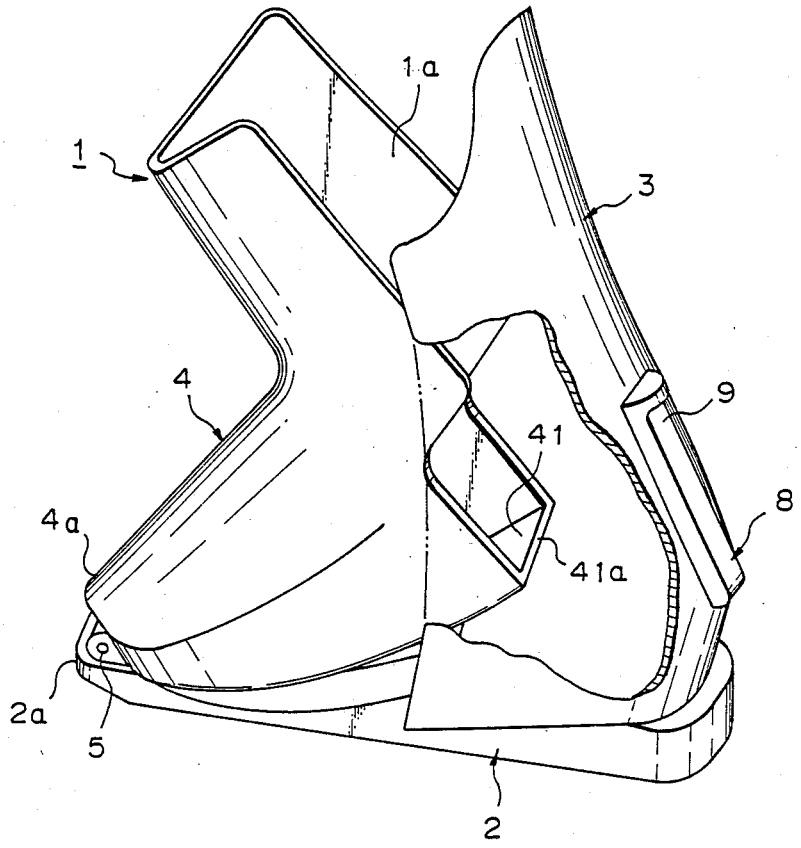
FIG. 8 is a perspective view of the third embodiment of the ski boot in accordance with the present invention in which its front shell is turned forwards.

The third embodiment of the ski boot 1 in accordance with the present invention is shown in FIG. 8, in which the rear end 41*a* of the insole 41 does not extends as far rearwards as those in the first and second embodiments.

Figure 9:
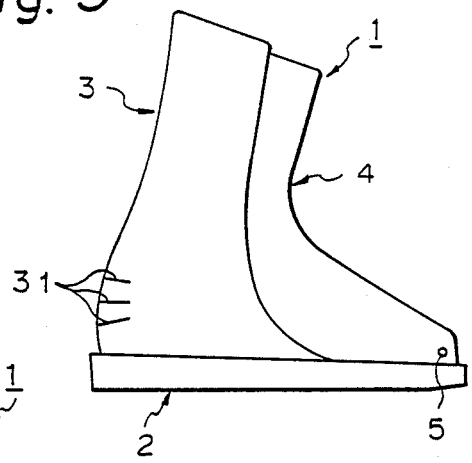
FIGS. 9 to 11 are side views of various examples of the rear shell used for the ski boot 1 in accordance with the present invention.
Figure 10:
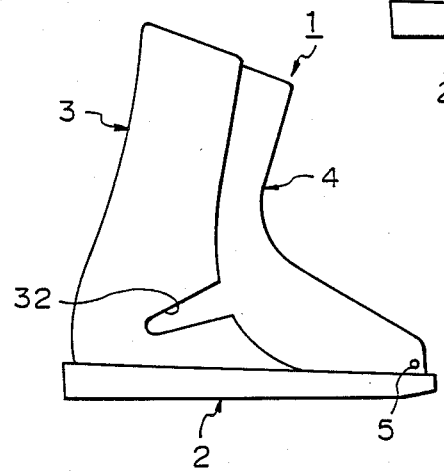
Figure 11:
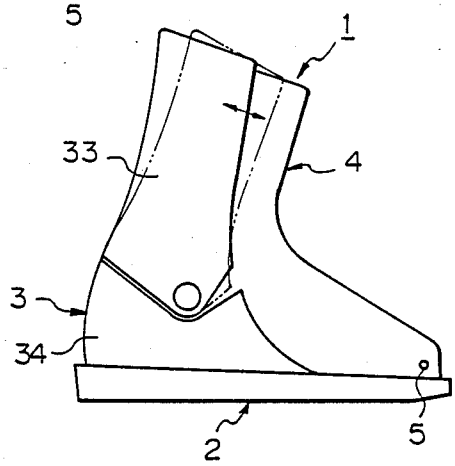

In the case of the foregoing embodiments, the rear shell 3 is formed in one body with the sole 2. Even with such a basic construction, it is preferable that the rear shell 3 be somewhat deformable so as to be rotatable forwards when the wearer tilts his leg forwards. This possibility of forward rotation is welcome particularly for beginners. In the example shown in FIG. 9, one or more horizontal slits 31 are formed in the rear face of the rear shell 3 near the bottom end thereof. In the example shown in FIG. 10, cutouts 32 are formed in the front edges of the rear shell 3. In the example shown in FIG. 11, the rear shell 3 is made up of a lower section 34 formed integrally with the sole 2 and an upper section 33 is pivoted at its lower end to the lower section 34.

In order to avoid invasion of snow, a crest may be formed on the edge of the one shell in an arrangement tightly engageable with an elongated recess formed in the corresponding edge of the other shell.

In accordance with the present invention, the rear shell is at least partly formed with the sole and the front shell is rotatable forwards about the front end of the sole. The forwardly rotatable construction of the front shell allows smooth entry of a wearer's foot into the ski boot without enlarging the entire construction of the ski boot, thereby affording good fit to and sufficient hold on the wearer's foot entering the ski boot. In addition, the integral construction of the rear shell with the sole can well withstand rearward tilting of the wearer's leg during skiing. The ideal fit and hold of the shells with respect to the wearer's foot allows use of a hard insole which can tightly embrace the foot.

I claim:

1. A ski boot made of a hard synthetic resin, said boot comprising:
   - a sole;
   - a front shell;
   - a rear shell, at least a part of said rear shell being formed integrally with said sole in such a manner that said rear shell cannot be rotated in a direction away from said front shell; and
   - said front shell being separate from said rear shell and being pivoted at its front end to the front end of said sole so as to be rotatable in the longitudinal direction of said sole toward and away from said rear shell.

2. A ski boot as claimed in claim 1 further comprising an inner sole formed integrally with said front shell.

3. A ski boot as claimed in claim 2 in which said inner sole extends rearwards into the region of said rear shell.

4. A ski boot as claimed in claim 3 in which said inner sole is provided at its rear end with an upstanding tongue.

5. A ski boot as claimed in claim 3 in which said inner sole is provided with an upstanding inner rear-cuff which is pivoted at its front end to the rear end of said inner sole.

6. A ski boot as claimed in claim 1 further comprising:
   - a retainer unit arranged in said sole and including a spring to assist upward and forward rotation of said front shell; and
   - a manually operable locker unit arranged on the rear face of said rear shell and including a release lever linked to said retainer unit to lock said front shell in its closed position.

7. A ski boot as claimed in claim 1 in which at least one lateral slit is formed in the rear face of said rear shell.

8. A ski boot as claimed in claim 1 in which cutouts are formed in the front edges of said rear shell.

9. A ski boot as claimed in claim 1 in which said rear shell is made up of a lower section formed integrally with said sole and an upper section pivoted at its lower end to said lower section.

* * * * *